United States Patent [19]

Chaffee

[11] 3,962,827

[45] June 15, 1976

[54] PANEL CONNECTOR

[75] Inventor: William H. Chaffee, Chicago, Ill.

[73] Assignee: Model Builders, Inc., Chicago, Ill.

[22] Filed: June 18, 1975

[21] Appl. No.: 588,068

[52] U.S. Cl. ..... 49/384; 16/171; 49/397; 160/135; 160/229 R

[51] Int. Cl.[2] ..... E05D 5/16

[58] Field of Search ..... 160/135, 351, 229 R, 160/231 R; 211/178 R, 182; 52/239, 502; 249/384, 383, 397, 462; 16/171

[56] References Cited

UNITED STATES PATENTS

| | | | |
|---|---|---|---|
| 2,619,689 | 12/1952 | Parrott | 49/384 |
| 3,086,626 | 4/1963 | Bowers | 52/502 X |
| 3,610,249 | 10/1971 | Baker et al. | 160/229 R X |
| 3,633,316 | 1/1972 | Belser | 49/384 |
| 3,722,702 | 3/1973 | Marker, Jr. | 211/178 R |
| 3,875,711 | 4/1975 | Palmer | 160/135 X |

*Primary Examiner*—Philip C. Kannan

*Attorney, Agent, or Firm*—Wegner, Stellman, McCord, Wiles & Wood

[57] ABSTRACT

A panel connector for use in connecting a plurality of panels such as to form a display. The connector is defined by a spring clip, of suitable length, forming an arcuate bead on the edge of the panel to be connected and adapted to be received in a complementary socket element. The clip includes inturned legs providing an improved support of the panel edge, maintaining the panel edge centered in the clip and against undesirable outward movement of the panel from the clip. The socket element may be arranged to permit selective angular disposition of the panel through a preselected wide angular range for facilitated arrangement of the panels as desired. The socket element may define a plurality of sockets for receiving a corresponding plurality of panel edges and opposite edges of the panels may be connected to different socket elements to permit a series arrangement of the panels and socket elements.

14 Claims, 9 Drawing Figures

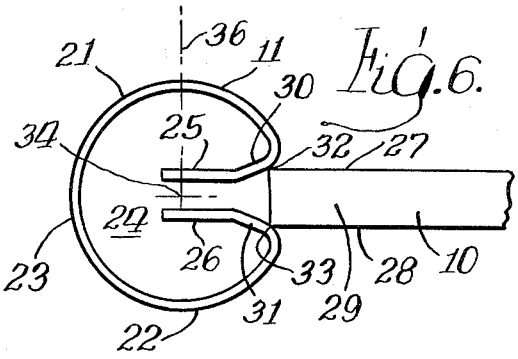
Fig. 6.
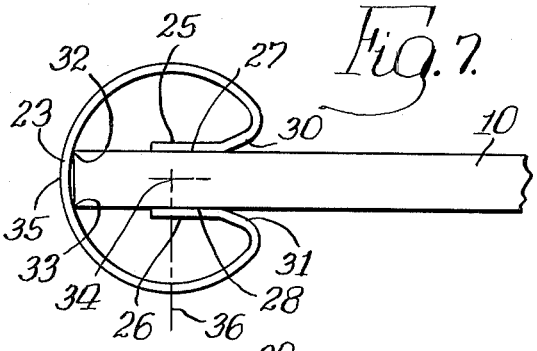
Fig. 7.
Fig. 8.
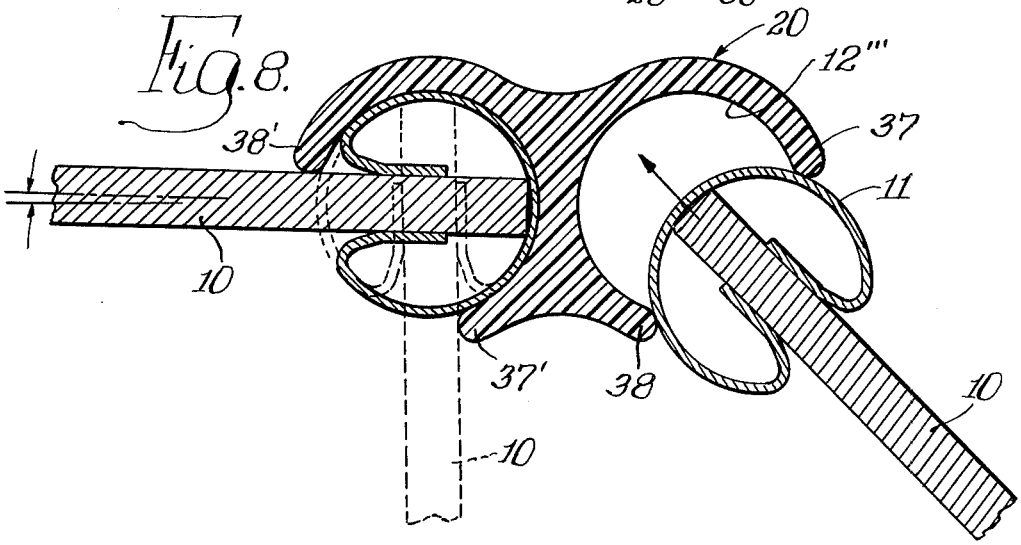
Fig. 9.
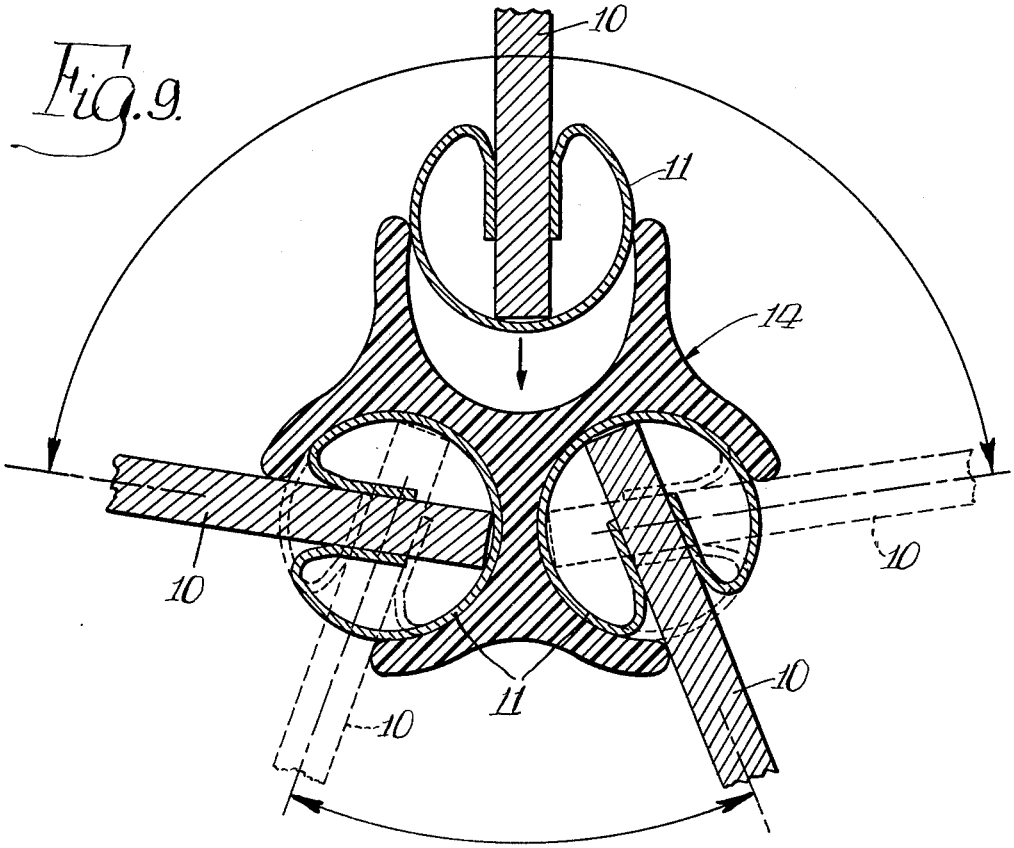

PANEL CONNECTOR

BACKGROUND OF THE INVENTION

1. Field Invention the invention

This invention relates to panel mounting systems and in particular to connectors for use therein.

2. Description of the Prior Art

As disclosed in U.S. Pat. No. 3,528,559 of Melvin M. Miller, a plurality of resilient foldable panels may be supported by panel members to provide a freestanding layrinth-like display. In the Miller display device, the panels are provided with prescored lateral margins receiving turned flanges at the outer ends of the socket elements. Miller recognizes that wear of the panels may permit a loose fit thereof in the channels and provides a set screw for selectively preventing slipping of the panels.

In window sash constructions, such as taught by Roy T. Axe in U.S. Pat. No. 1,594,765, a U-shaped sash member is provided for receiving the margin of a glass pane.

In U.S. Pat. No. 1,716,857 of Eugene E. Kern, glass panels are supported in a metal clip provided with a crease for gripping the panel edge.

John A. Bohnsack, in his U.S. Pat. No. 3,081,504, shows a glazing assembly utilizing a mounting clip received in a socket of the window frame.

In U.S. Pat. No. 3,086,626, Peter Bowers shows glazing and cladding arrangements utilizing a spring clip for attaching the edge of glass panes to a socket structure.

In U.S. Pat. No. 3,144,881 of Wayne T. Sproull, a construction element is illustrated defining a plurality of sockets receiving the edges of duct panels to make up a duct bank assembly.

Another form of clip for holding model roadbeds in toy railways and the like is shown in U.S. Pat. No. 3,225,487 of Durham F. Mallalieu. The Mallalieu clip is generally similar to the Miller clip in having turned portions received in a formed recess in the roadbed element.

Charles S. Ogsbury et al, in U.S. Pat. No. 3,597,858, show a scale building set wherein panels are provided with integral beads to be received in arcuate socket elements for selective angular disposition.

Robert MacBride, in U.S. Pat. No. 3,757,430, shows a flexible module which utilizes beads on the edges of the panels received in arcuate sockets generally similar to the structure of Ogsbury et al.

In U.S. Pat. No. 3,871,143, Elwyn B. Quick shows building elements for beach and play structures having cylindrical beads provided on the edges of the panels to be received in complementary arcuate sockets.

Lewis M. King et al, in U.S. Pat. No. 3,234,996, show a sound retarding folding partition provided with strip hinges interconnecting adjacent edges of elongated panels by means of integral cylindrical beads received in arcuate sockets on the panels.

Sol Garbus, in U.S. Pat. No. 3,297,077, shows a folding door structure having interconnecting strips of flexible material provided with arcuate beads received in complementary sockets attached to the edges of the panels by rib and groove structures generally similar to that of the Miller structure discussed above.

Charles E. Plastow, in U.S. Pat. No. 3,314,551, shows a display device wherein a panel is received in a connector having a socket portion receiving a complementary cylindrical bead of a mounting element. In the preferred form, the panel-receiving channel is provided with longitudinally extending ribs.

In U.S. Pat. No. 3,592,289 of James E. Aysta et al, freestanding acoustical space dividers are shown utilizing flexible plastic couplings having integral enlarged edges received in longitudinal grooves of the frame members.

SUMMARY OF THE INVENTION

The present invention comprehends an improved panel mounting system wherein the panel edges are received in a spring clip adapted to be removably installed in a support socket. The clip may have any suitable length, including the full length of the panel edge, as desired.

The spring clip defines inturned leg portions receiving the panel edge therebetween and providing improved maintained centered relationship and gripping relationship with the panel.

More specifically, the present invention comprehends providing such a panel mounting clip defined by a pair of opposed leg portions and an interconnecting bight portion. The leg portions define inturned substantially recilinear distal ends having a length at least approximately one-half the diameter of the clip so as to provide the improved gripping of the panel edge as discussed above.

The leg portions may further define an angled entrance portion at the outer end of the gripping portions of the inturned legs for facilitated insertion of the panel edge into the clip.

The bight portion of the clip may comprise an arcuate portion adapted to be engaged by the inner corners of the panel edge and assist the inturned leg portions in maintaining the panel diametrically centered in the clip.

Prior to the insertion of the panel edge therebetween, the inturned legs are spaced apart less than the thickness of the panel edge. The diameter of the clip prior to the insertion of the panel edge therein may be less than the diameter of the support socket. The diameter of the clip may be substantially equal to the diameter of the support socket when the panel edge is inserted thereinto to provide improved stabilized positioning of the panel relative to the support.

Thus, the connecting system of the present invention provides an improved readily adjustable, but stabilized, arrangement of one or more panels in a preselected configuration without requiring modification of the panel edge portions to accommodate the mounting structure. The mounting structure provides an effectively positive retention of the panels in normal use while yet permits ready assembly and disassembly thereof as desired.

Thus, the connector system of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 6 is a fragmentary top plan view illustrating a first step in the insertion of a panel edge into the mounting clip of the connector;

FIG. 7 is a fragmentary top plan view illustrating the assembly of the panel edge to the mounting clip of the connector;

FIG. 8 is a horizontal section illustrating the insertion of the panel edge and clip mounted thereon into the socket support and the range of adjustment of the panel edge in the socket; and FIG. 9 is a fragmentary horizontal section further illustrating the range of adjustability of the panel in a socket support embodying the invention.

DESCRIPTION OF THE PREFERRED EMBODIMENTS

Figure 1:
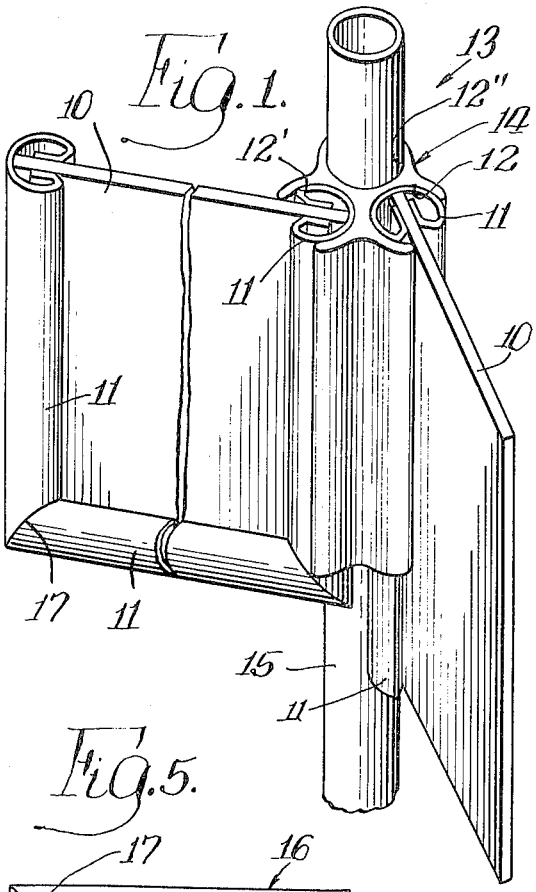
FIG. 1 is a fragmentary perspective view of a panel display utilizing a connector system embodying the invention.

In the exemplary embodiments of the invention as disclosed in the drawing, one or more panels 10 are arranged to be mounted to a support means by a readily installable clip 11. The support means may comprise any one of a plurality of different support structures, as illustrated in the drawing, each of which, however, utilizes identical socket means 12 for receiving the mounting clip 11 in supporting the panel 10 in the mounting system. Illustratively, as shown in FIG. 1, a panel mounting system generally designated 13 includes a trifurcated support 14 defining three sockets 12, 12' and 12''. As shown in FIG. 1, the sockets may receive the clips 11 for positioning the panels 10, on which the clips are mounted, in desired angular relationship. As shown in FIG. 1, the support 14 may be mounted to a vertical post 15 received in socket 12''.

Figure 5:
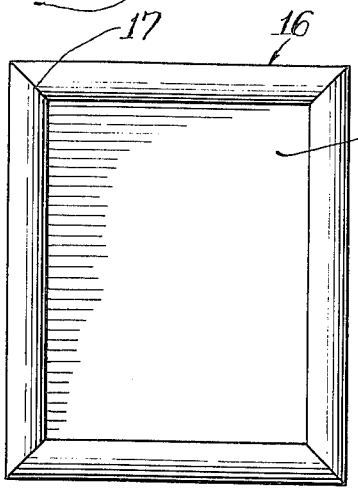
FIG. 5 is a front elevation of a panel display utilizing the clip means of the present invention as a panel frame.

As further shown in FIGS. 1 and 5, the mounting clips 11 may be arranged peripherally on different edges of the panels to define a frame such as frame generally designated 16 illustrated in FIG. 5. In providing such a frame, the ends of the mounting clips may be beveled as at 17 to provide mitered corners in the conventional framing manner.

Figure 2:
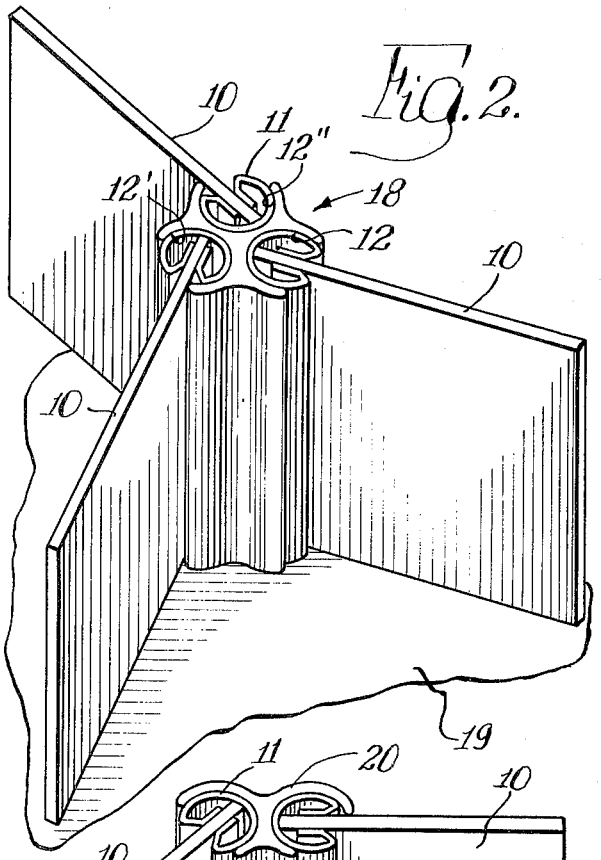
FIG. 2 is a perspective view of a modified form of a panel display utilizing the connector system.

The invention may be utilized to provide different forms of panel mounting systems as discussed above. Thus, as shown in FIG. 2, another form of panel mounting system generally designated 18 is shown to comprise a system similar to system 13 of FIG. 1, but wherein the support post 15 is replaced by a third panel provided with a clip 11 for mounting in the socket 12'' to provide a freestanding panel mounting arrangement wherein the arrangement is adapted to mount on a subjacent surface 19 with the panels in desired angular relationship.

Figure 3:
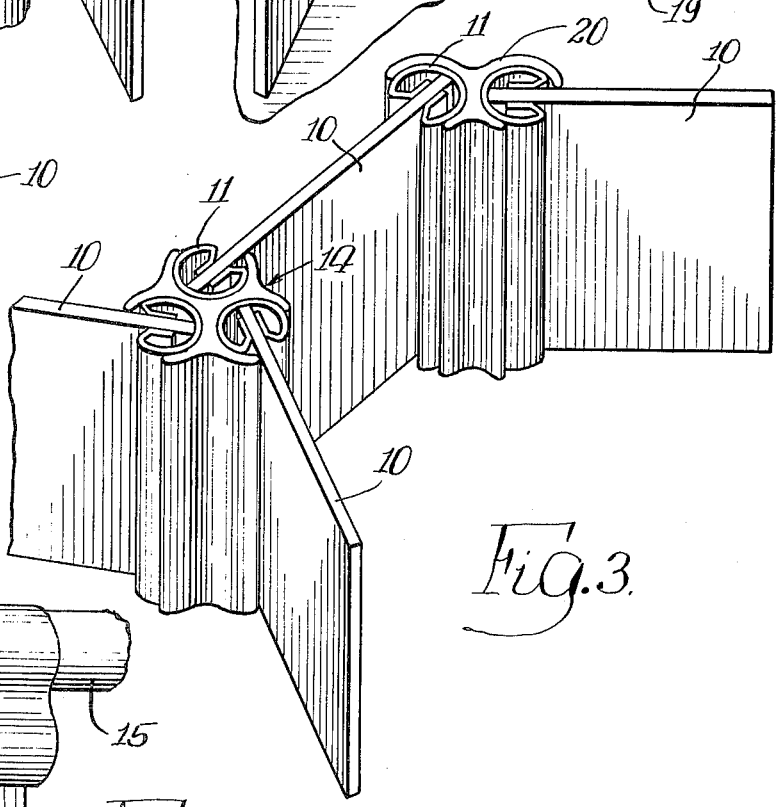
FIG. 3 is a fragmentary perspective view of a further modified panel display utilizing a pair of support portions of different configuration.

As further illustrated in FIG. 3, opposite edges of the panels 10 may be utilized to provide a series relationship of the panels. Thus, the opposite edges may be provided with the clips 11 for reception in sockets of a plurality of supports such as trifurcated support 14 and bifurcated support 20.

Figure 4:
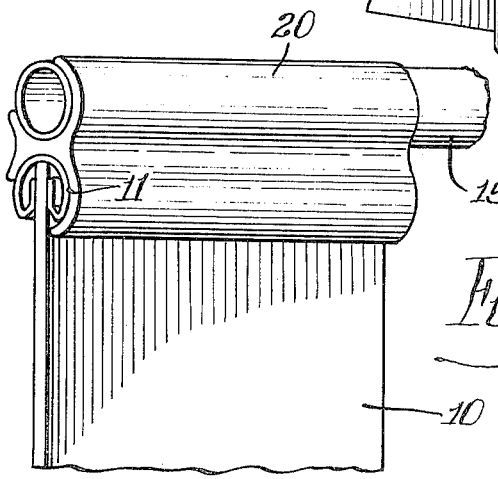
FIG. 4 is a fragmentary perspective view of a further different panel display utilizing a different support means.

Further alternatively, the bifurcated support 20 may be utilized with one of the sockets receiving the support port 15 and the other of the sockets supporting a panel 10 by means of the edge-mounted clip 11. As illustrated in FIG. 4, this arrangment may be utilized to define a hangertype display wherein the panel 10 depends from the hanger support 20 carried on the horizontal post 15.

The different panel mounting systems of FIGS. 1–4 and the use of the mounting clips 11 as framing elements may be combined in different combinations and permutations as desired, as will be obvious to those skilled in the art. The different panel mounting systems as thus disclosed are exemplary only.

As indicated briefly above, the present invention comprehends the provision of an improved connector for connecting the panel edge adjustably to the socket support. The connector and its association with the panel edge may best be seen in FIGS. 6 and 7. As shown therein, the connector comprises a spring clip 11 defining a pair of opposed leg portions 21 and 22 and an interconnecting bight portion 23 cooperatively defining a panel edge receiving space 24. Leg portions 21 and 22 severally define inturned, substantially rectilinear distal ends 25 for gripping the opposite sides 27 and 28 of the edge 29 of panel 10 when the panel edge is inserted therebetween, as shown in FIG. 7.

In the illustrated embodiment, the spring clip comprises a right circularly segmentally cylindrical element wherein each of legs 21 and 22 and bight 23 comprises arcuate portions. The clip may have any desired suitable length.

As shown, the inturned gripping end portions 25 and 26 may be connected to the arcuate legs 21 and 22 by a pair of complementary angled, inwardly converging guide portions 30 and 31 which may be rectilinear as illustrated in FIG. 6. As shown, the length of the guide portions 30 and 31 may be substantially less than the length of the gripping end portions 25 and 26. The guide portions are engaged by the corners 32 and 33 of the panel edge 28 to guide the panel edge into the space between inturned leg ends 25 and 26 and permit the corners 32 and 33 to abut the arcuate bight 23 in the fully inserted assembled arrangement of FIG. 7.

Thus, while the spring clip 11 may be formed of resilient material, such as spring metal, the rectilinear gripping portions 25 and 26 may effectively retain the panel 10 centered on the central axis 34 of the clip and the center 35 of the bight 23 so as to maintain the clip effectively symmetrically arranged on the panel edge at all times. The engagement of corners 32 and 33 may further assist the gripping means 25 and 26 in maintaining the desired centered relationship of the panel to the clip, as illustrated in FIG. 7.

To assure the desired maintained centered relationship, the rectilinear gripping portions 25 and 26 preferably have a substantial length, and in the illustrated embodiment, have a length of at least approximately one-half the diameter of the clip. As illustrated in FIGS. 6 and 7, the inturned gripping portions 25 and 26 may extend inwardly toward bight 23 beyond the axis 34, i.e., the plane 36 defined by axis 34 extending perpendicular to the longitudinal extent of the rectilinear gripping portions 25 and 26.

The unexpanded diameter of the clip, as shown in FIG. 6, may be slightly less than the diameter of the socket of the mounting support. In the different supports, each of the sockets may have the same diameter. In the expanded arrangement of the clip, i.e., when the panel edge is inserted thereinto, as shown in FIG. 7, the diameter of the clip at plane 36 may be substantially equal to the diameter of the socket to provide improved positive mounting of the panel edge in the socket, as illustrated in FIGS. 8 and 9.

More specifically, as shown in FIG. 8, the mounting of panels 10 to the bifurcated socket support 20 may be readily effected by inserting the mounted clip 11 into the socket 12''' with the panel edge centered in the clip and being urged into the socket parallel to the flatwise extent thereof. The socket may comprise a segmentally cylindrical socket having an angular extent of greater than 180° whereby the support defines a pair of entrance lips 37 and 38 which are sprung apart by the clip as it is inserted into the socket. The support may be formed of a suitable resilient material, such as molded synthetic resin, and readily accommodates the insertion expansion.

Upon reception of the clip in the socket, the panel may then be suitably disposed over an angular range determined by the spacing between the lips in the assembled arrangement. Thus, as shown in FIG. 8, the lips 37' and 38' are spaced angularly apart slightly greater than 90° to permit the panel to be adjusted correspondingly angularly at any position within this range between the full line position and the dotted line position illustrated therein.

As shown in FIG. 9, the trifurcated socket support 14 provides a similar angular adjustment range for the different panels with the three sockets opening outwardly in the support at 120° spaced positions. In the trifurcated support, however, the sockets may be centered on the 120° positions. In the illustrated embodiment, the spacing between the lips 37, 38 may be approximately 119°, and in the trifurcated support, the spacing between the lips may be approximately 102°. Thus, with a ⅛ in. panel being retained in the clips where the socket has a 0.5 inch diameter, the panel may have a swing of approximately 92° in the bifurcated support 20 and approximately 87° in the trifurcated support 14.

In one form of the invention, the socket supports were extruded from polyvinyl chloride material. In the trifurcated support, the lips had a thickness of approximately 0.065 inch, and in the bifurcated support, the lips had a thickness of approximately 0.055 inch. In one form, the clip was fabricated of 0.015 inch Type 302 ¼ hard stainless steel strip with the gripping portions 25 and 26 having a length of approximately 5/32 inch and extending beyond the plane 36 approximately 1/32 inch. The unexpanded spacing between the portions 25 and 26 was approximately 0.062 inch and the angle of the inclined entrance portions 30 and 31 was approximately 20° to the plane of the end portions 25 and 26. The outer end of the portions 30 and 31 was connected to the leg portions 21 and 22 by a 0.0625 inch radius.

The above dimensions and material characteristics are exemplary only.

The foregoing disclosure of specific embodiments is illustrative of the broad inventive concepts comprehended by the invention.

I claim:

1. In a panel mounting system wherein a panel edge is mounted to a support defining a segmentally cylindrical socket, an improved connector for connecting the panel edge adjustably to said support comprising a spring clip defining a pair of opposed leg portions and an interconnecting bight portion defining a panel edge receiving space, each of said leg portions defining an inturned, substantially rectilinear distal end having a length at least approximately one-half the dimension of said clip outwardly from an innermost portion of said bight for effectively gripping opposite sides of the panel edge therebetween.

2. The panel mounting system of claim 1 wherein each of said leg portions further defines an angled entrance portion at the outer end of said distal end.

3. The panel mounting system of claim 1 wherein the inner termination of the distal end of each of said leg portions is disposed between the innermost portion of said bight and a plane through the center of said space perpendicularly between said distal leg ends.

4. The panel mounting system of claim 1 wherein said socket is right circularly segmentally cylindrical and said spring clip is complementarily segmentally right circularly cylindrical.

5. The panel mounting system of claim 1 wherein the spacing between said distal leg ends is preselected to be less than the thickness of said panel edge prior to insertion of the panel edge therebetween.

6. The panel mounting system of claim 1 wherein the spacing between said distal leg ends is preselected to be less than the thickness of said panel edge prior to insertion of the panel edge therebetween, and said legs further define inwardly converging guide surfaces on the outer end of said distal leg ends for guiding the panel edge to between said distal leg ends for retaining the panel edge grippingly therebetween.

7. The panel mounting system of claim 1 wherein said bight portion defines outwardly diverging inner portions disposed to engage opposite corners of the panel edge when the panel edge is fully inserted into said space between said distal leg ends whereby said panel edge is supported at four spaced positions.

8. The panel mounting system of claim 1 wherein said bight portion is right circularly segmentally cylindrical and defines outwardly diverging inner portions disposed to engage opposite corners of the panel edge when the panel edge is fully inserted into said space between said distal leg ends whereby said panel edge is supported at four spaced positions.

9. In a panel mounting system wherein a panel edge is mounted to a support defining a right circularly segmentally cylindrical socket, an improved connector for connecting the panel edge adjustably to said support comprising a right circularly segmentally cylindrical spring clip defining a pair of opposed arcuate leg portions and an interconnecting bight portion defining a panel edge receiving space, each of said leg portions carrying an inturned, substantially rectilinear gripping portion having a length at least approximately one-half the diameter of said clip for effectively gripping opposite sides of the panel edge therebetween.

10. The panel mounting system of claim 9 wherein said leg portions define rectilinear inwardly converging connecting portions connecting said rectilinear gripping portions to said arcuate leg portions.

11. The panel mounting system of claim 9 wherein the diameter of said spring clip prior to insertion of the panel edge therebetween is less than the diameter of said socket.

12. The panel mounting system of claim 9 wherein the diameter of said spring clip prior to insertion of the panel edge therebetween is less than the diameter of said socket and is approximately equal to the diameter of the socket when the panel edge is inserted thereinto.

13. The panel mounting system of claim 9 wherein said leg portions define inwardly converging connecting portions connecting said rectilinear gripping portions to said arcuate leg portions, each of said connecting portions including a substantially rectilinear inner portion connected to said gripping portion and an arcuate outer portion connected to the arcuate leg portion.

14. The panel mounting system of claim 9 wherein said leg portions define inwardly converging connecting portions connecting said rectilinear gripping portions to said arcuate leg portions, each of said connecting portions including a substantially rectilinear inner portion connected to said gripping portion, said substantially rectilinear inner portion of the connecting portion having a length substantially less than that of the gripping portion, and an arcuate outer portion connected to the arcuate leg portion.

* * * * *